US005388491A

United States Patent [19]

John

[11] Patent Number: 5,388,491

[45] Date of Patent: Feb. 14, 1995

[54] CELLO TUNING PEG

[76] Inventor: Krovoza John, 1780 E. Woodbury Rd., Pasadena, Calif. 91104

[21] Appl. No.: 55,505

[22] Filed: Apr. 29, 1993

[51] Int. Cl.[6] ..... G10D 3/14

[52] U.S. Cl. ..... 84/304; 84/458

[58] Field of Search ..... 84/304, 458, 297 R

[56] References Cited

U.S. PATENT DOCUMENTS

| | | | |
|---|---|---|---|
| 2,558,059 | 6/1951 | Nyhagen | 84/304 |
| 4,278,002 | 7/1981 | Siminoff | 84/304 |
| 5,272,953 | 12/1993 | Koch | 84/458 |

*Primary Examiner*—Michael L. Gellner
*Assistant Examiner*—Patrick J. Stanzione
*Attorney, Agent, or Firm*—Frederick Gotha

[57] ABSTRACT

A tuning peg for a cello musical instrument where the tuning peg has a tapered cylindrical body which has an axially extending recess therein. A handle is removably mounted to the cylindrical body and has an axially extending connecting member which is adapted for insertion into the cavity. Upon insertion of the connecting member in whole or in part into the recess, the handle and cylindrical body are in fixed rotational relationship which permits the cylindrical body to be rotated in order to increase or decrease the tension in the cello string. After tuning the string, the handle is removed from the cylindrical body which permits the player to rest the neck of the cello against his neck and therefore play the instrument in an upright position.

10 Claims, 2 Drawing Sheets

CELLO TUNING PEG

FIELD OF THE INVENTION

This invention relates to an improved tuning peg for a cello musical instrument.

BACKGROUND OF THE INVENTION

Tuning pegs presently used on cello musical instruments have handle members integrally part of the cylindrical peg portion of the tuning peg and which extend laterally and oppositely from the tuning box of the instrument. The lateral protrusion of the handles which are nearest to the musician's head prevent the musician from resting the neck of the instrument comfortably against his neck and therefore from attaining a posture in which his cervical or spinal vertebra may be extended to reduce back strain and to achieve enhanced freedom of movement. The lateral extension of the tuning pegs closest to the musician's head compel the musician to play the instrument in a hunched position and thereby inhibit the musician from attaining a healthy posture while the instrument is being played. Because of the poor posture that the cello musician is compelled to maintain while playing the instrument, cellists experience a high rate of back discomfort and in many cases injury which ultimately prevents the cellist from playing the instrument for any extended periods of time.

SUMMARY OF THE INVENTION

There is, therefore, provided according to the present invention, an improved cello tuning peg which permits enhanced spinal extension while the musician is playing the instrument.

The present invention is directed to an improved tuning peg having a longitudinal axis where the tapered cylindrical body portion of the peg has a handle which is removably coupled to the cylindrical body member for winding or unwinding the string so as to selectively increase or decrease the tension in the string. A longitudinally extending recess is contained in the cylindrical body for receiving a connecting member which is integrally formed with and extends longitudinally from the handle such that upon insertion of the longitudinally extending connecting member into the recess, the handle is coupled to the cylindrical body. Rotation of the handle will impart rotation to the cylindrical body to selectively tune the string and after the string is tuned, the handle is removed from the recess and detached from the cylindrical body. This permits the musician to bring his head closer to the neck of the instrument and therefore play the instrument in an upright position rather than in a hunched position.

BRIEF DESCRIPTION OF THE DRAWINGS

These and other features and advantages will become appreciated as the same become better understood with reference to the following specification, claims and drawings wherein:

DETAILED DESCRIPTION

Figure 2:
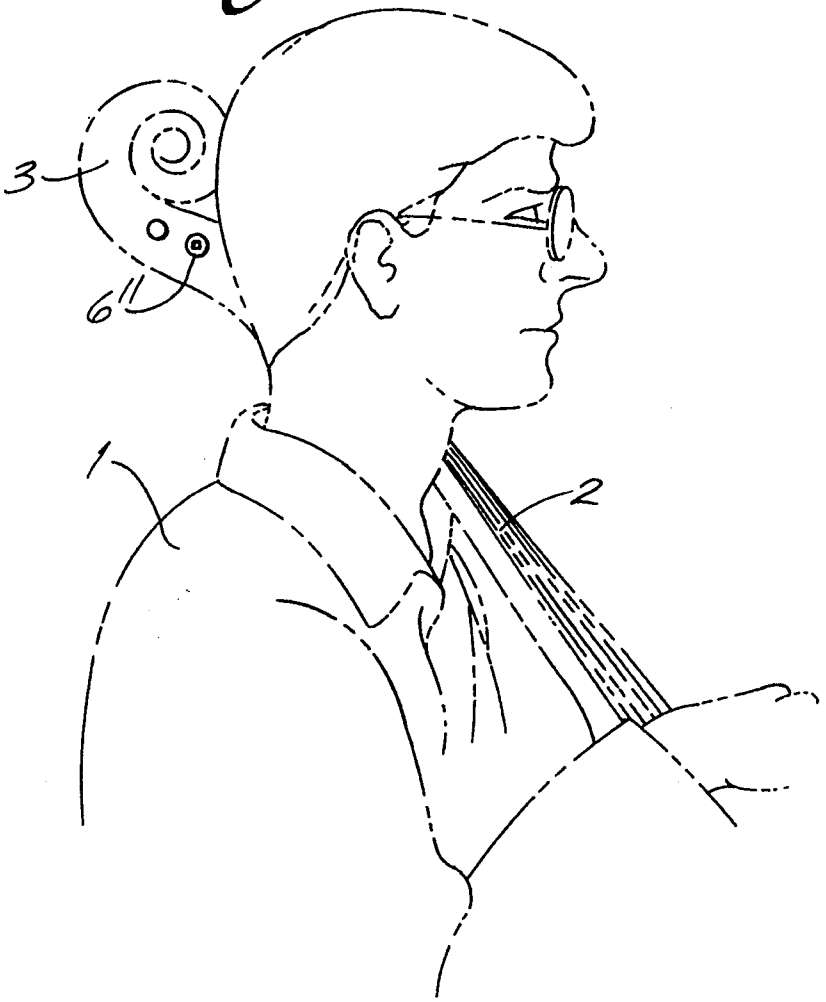
FIG. 2 illustrates the posture of a musician playing the cello having the tuning pegs of this invention.
Figure 1:
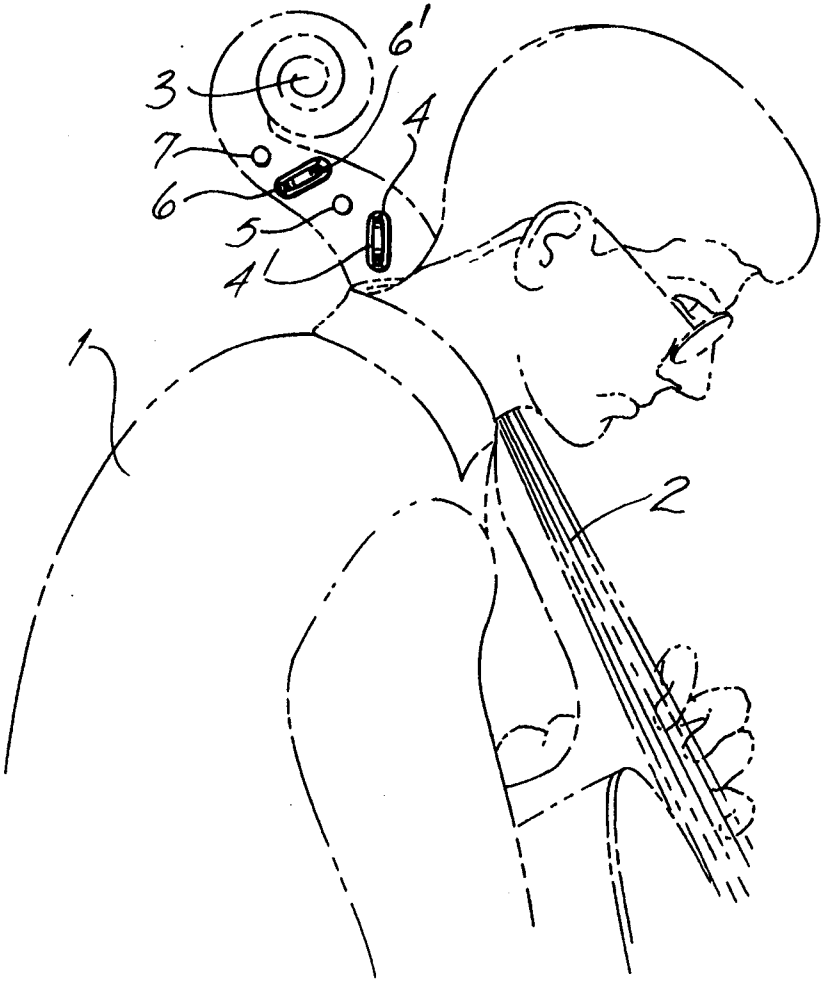
FIG. 1 illustrates the posture of a musician playing a cello having tuning pegs of the prior art.

FIG. 1 is an illustration of a musician playing a cello which has the tuning pegs of the prior art. As can be seen in FIG. 1, the musician cannot play the instrument in an upright position; but is required to hunch his back in order to rest the neck of the instrument against his shoulder and neck. In FIG. 2, a cello instrument having the tuning pegs of the present invention is illustrated and it can be seen that the musician is permitted to straighten his back and place his head in an upright position along the neck of the cello instrument.

Referring again to FIG. 1, a silhouette 1 of the musician is shown with the cello neck 2 resting against the musician's shoulder and neck. The tuning box 3 extends from the upper end of the cello neck 2 and contains four tuning pegs, 4, 5, 6 and 7; handles 4' and 6' of tunings pegs 4 and 6 extend laterally from tuning box 3 in the direction of the musician's body and the handles 5' and 7' of tuning pegs 5 and 7 extend laterally in a direction from the tuning box 3 oppositely to handles 4' and 6'. The tuning peg handles serve as grips for turning the tuning pegs in order to increase or decrease the tension in the cello strings. FIG. 1 is an illustration of the prior art tuning peg and it can be seen in FIG. 1 that as a result of the lateral extension of handles 4' and 6' that the musician must hunch his back in order to rest the neck of the cello instrument 2 against his shoulder. The present invention which is illustrated in FIG. 2 allows the musician to sit upright while playing the instrument. As can be seen in FIG. 2, the handle portion of the tuning pegs 6'' and 4'' (handle portion of 4'' not shown in the drawing) have been removed and therefore present no obstruction to the musician placing his head upright and alongside the neck of the instrument.

Figure 3:
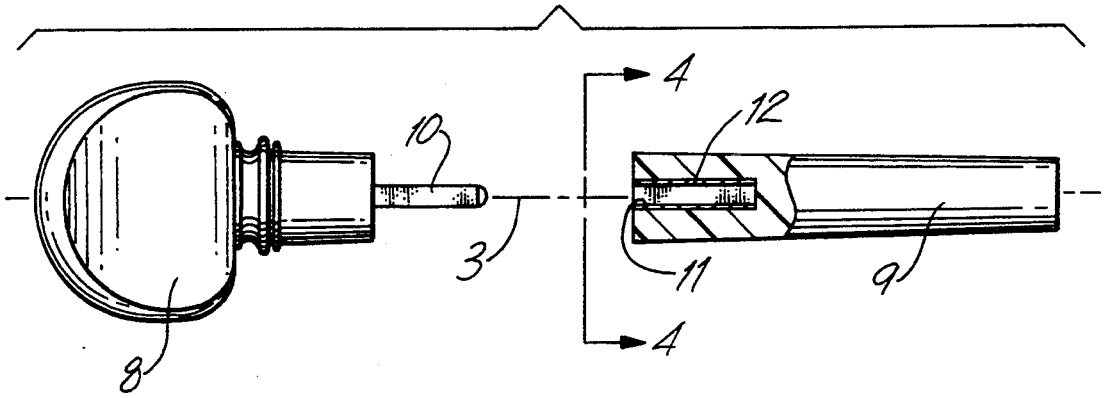
FIG. 3 is a exploded partial cross-sectional view of the improved tuning peg of this invention.
Figure 4:
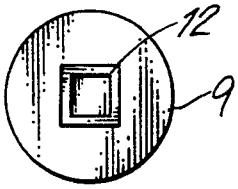
FIG. 4 is a sectional view taken along the lines 4—4.

An embodiment of the tuning peg of this invention is illustrated in FIG. 3. As can be seen in FIG. 3, the handle portion 8 of the tuning peg is removably mounted to the cylindrical body 9 of the tuning peg where the cylindrical body is decreasingly tapered in a direction opposite from the handle end of the tuning peg. Handle portion 8 has an extension or connecting member 10 which is fixed to the handle portion 8 and has a substantially square cross-section for insertion into the recess 11. By referring to FIG. 4, it can be seen that recess 11 is of a substantially square cross-section and contains a sleeve 12 for insertion into the recess where the sleeve is also of a substantially square cross-section and has a longitudinally extending cavity for receiving extension member 10.

The improved tuning peg of this invention has a longitudinal axis 13 about which the cylindrical body portion 9 of the tuning peg is radially symmetrical. The cylindrical body contains a recess 11 into which the extension member 10 of the handle 8 may be inserted in order to rotate the cylindrical body so as to increase or decrease the tension in the musical string which is wound about cylindrical body 9. Since handle portion 8 is removable from cylindrical body 9, the tuning peg of this invention may be rotated by turning the handle to achieve a selected tension in the musical string and the handle thereafter removed by withdrawing extension member 10 from recess 11. The detachment of the handle portion 8 from the tuning peg recess removes the protrusion from the tuning peg which precluded the musician from resting the cello neck against his shoulder and neck such that his head could be comfortably maintained in an upright position. It is preferred that the tuning peg of this invention be made of a wood material; however, the handle portion 8 or cylindrical body may also be made of a plastic material.

Although FIG. 3 discloses a recess and sleeve for receiving extension member 10 of substantially square cross-section, other embodiments, although not shown, could also be utilized to couple the handle to the cylindrical body to effectuate rotation of cylindrical body 9. For instance, the extension member 10 may be of triangular cross-section and the recess of a triangular cross-section, or the extension member 10 may be of an oval or elliptical shape and the cavity in the cylindrical body 9 also of an oval or elliptical shape such that extension member 10 would be captively held in the recess to transmit rotation of handle portion 8 to cylindrical body 9.

While an improved tuning peg device has been shown and described which enables the musician to play a cello with his head in an upright position and in an essentially upright posture, it is to be understood that it is subject to many modifications without departing from the scope and spirit of the claims as recited herein.

What is claimed is:

1. An improved cello tuning peg of the type having a cylindrical body member with a longitudinal axis for accepting a string and having a handle in fixed rotational relationship relative to said cylindrical body where said longitudinal axis is the axis of rotation of said cylindrical body for turning said cylindrical body to selectively change the tension in said string wherein the improvement comprises, means associated with said handle and said cylindrical body for slideably and detachably telescopically mounting said handle in contemporaneous axial sliding and fixed rotatinal relationship with said cylindrical body where said means is without restriction to free axial removal of said handle from said cylindrical body such that upon axial slideable telescopic engagement of said handle and said cylindrical body said handle and said cylindrical body are connected contemporaneously in fixed rotational and axial slideable relationship with respect to said axis of rotation thereby permitting said handle to be rotated to selectively change the tension in said string and to be freely removeable axially without restriction from said cylindrical body.

2. The improved cello tuning peg recited in claim 1 wherein said means comprises a connecting member integrally attached to said handle and extending a fixed distance longitudinally from said handle and a recess contained in said cylindrical body where said recess is so configured and proportioned that upon axial slideable telescopic engagement of said connecting member with said recess, said handle and said cylindrical body are telescopically mounted in contemporaneous axial slideable and fixed rotational relationship.

3. The improved cello tuning peg recited in claim 2 wherein said means further comprises a sleeve member having an outer and inner surface and a longitudinally extending cavity therein bounded by said inner surface disposed in whole or in part within said recess wherein said cavity is so configured and proportioned that upon slideable insertion of said connecting member in whole or in part into said cavity said handle and said cylindrical body are telescopically connected in contemporaneous axial slideable and fixed rotational relationship without restriction to free axial removal of said handle from said cylindrical body.

4. The improved cello tuning peg recited in claim 1 wherein said cylindrical body is axially tapered.

5. A cello tuning peg comprising:

(a) a cylindrical body having a longitudinal axis of rotation, and a first end and second end where said first end contains an opening and said cylindrical body has an axially extending cavity therein communicating with said opening;

(b) a handle slideably and removably mounted without restriction to free axial removal of said handle from said cylindrical body and having an axially extending connecting member adapted for insertion into said cavity where said connecting member and said cavity are so configured and proportioned that upon axial slideable telescopic engagement of said connecting member in whole or in part with said cavity said handle and said cylindrical body are connected in contemporaneous axial sliding and fixed rotational relationship whereby rotation of said handle will impart rotation to said cylindrical body and axial removal of said handle from telescopic engagement with said cavity is without restriction.

6. The cello tuning peg recited in claim 5 further comprising a sleeve member having an axially extending passage therein mounted to said cylindrical body and disposed in whole or in part within said cavity for slideably receiving said connecting member in telescopic sliding engagement where said passage is so configured and proportioned that upon axial slideable insertion of said connecting member in whole or in part into said passage said handle and said cylindrical body are connected in contemporaneous axially sliding and fixed rotational relationship.

7. The improved cello tuning peg recited in claim 4 wherein said cylindrical body is axially tapered.

8. In combination:

(a) a cello musical instrument; and (b) a cello tuning peg comprising a cylindrical body having a longitudinal axis of rotation, and a first end and a second end, where said first end contains an opening and said cylindrical body has an axially extending cavity therein communicating with said opening, a handle slideably and removably mounted without restriction to free axial removal from said cylindrical body and having an axially extending connecting member adapted for axial slideable insertion into said cavity where said connecting member and said cavity are so configured and proportioned that upon axial slideable insertion of said connecting member in whole or in part into said cavity, said handle and said cylindrical body are connected in contemporaneous axial sliding and fixed rotational relationship whereby rotation of said handle will impart rotation to said cylindrical body and said handle is without restriction to free axial removal from said cylindrical body.

9. The combination recited in claim 8 wherein said cylindrical body further comprises a sleeve member having an axially extending passage therein disposed in whole or in part within said cavity where said passage is so configured and proportioned that upon axial slideable insertion of said connecting member in whole or in part into said passage said handle and said cylindrical body are connected in contemporaneous axial sliding and fixed rotational relationship.

10. The combination recited in claim 8 wherein said cylindrical body is axially tapered.

* * * * *